United States Patent [19]

Rush

[11] 4,229,905

[45] Oct. 28, 1980

[54] COMBINED DOOR AND WINDOW FRAME SYSTEM

[76] Inventor: Jerome B. Rush, 3 Stanhope Pl., London, W.2., England

[21] Appl. No.: 874,557

[22] Filed: Feb. 2, 1978

[30] Foreign Application Priority Data

Feb. 2, 1977 [GB] United Kingdom ..... 4209/77

[51] Int. Cl.[2] ..... E06B 3/32

[52] U.S. Cl. ..... 49/143; 52/207; 52/209; 49/425; 49/471

[58] Field of Search ..... 49/143, 425, 420, 471; 52/207, 209

[56] References Cited

U.S. PATENT DOCUMENTS

| | | | |
|---|---|---|---|
| 2,663,917 | 12/1953 | Peterson | 52/207 X |
| 2,788,097 | 4/1957 | Frick | 49/425 X |
| 2,851,695 | 9/1958 | Dietrich | 49/169 X |
| 2,950,756 | 8/1960 | Moloney | 49/425 X |
| 3,410,027 | 11/1968 | Bates | 49/471 |
| 3,852,915 | 12/1974 | Schacht | 49/143 |

FOREIGN PATENT DOCUMENTS

| | | | |
|---|---|---|---|
| 2517009 | 4/1975 | Fed. Rep. of Germany | 49/425 |
| 388360 | 7/1931 | United Kingdom . | |
| 411064 | 5/1934 | United Kingdom . | |
| 566038 | 12/1944 | United Kingdom . | |
| 1178748 | 1/1970 | United Kingdom . | |
| 1244322 | 8/1971 | United Kingdom . | |

*Primary Examiner*—Kenneth Downey

*Attorney, Agent, or Firm*—Hopgood, Calimafde, Kalil, Blaustein & Lieberman

[57] ABSTRACT

An elongate frame member of uniform cross-section is provided for a combined door and window frame assembly. The said frame member is adapted to divide an outer perimeter frame into two areas, one to accommodate an opening window and the other to accommodate a sliding door in its closed position and comprises a rigid supporting portion, an elongate recess of L-shaped cross-section to receive one edge of the window and an elongate flange connected to the supporting portion and spaced therefrom by an intervening web, said flange being so positioned, in the assembled frame, that a part of the sliding door when closed can engage between the flange and the supporting portion to facilitate a draught proof seal.

11 Claims, 5 Drawing Figures

COMBINED DOOR AND WINDOW FRAME SYSTEM

This invention relates to frames in which can be mounted sliding doors, together with fixed panels and/or window units which may be fixed or openable.

Known sliding patio door systems have various disadvantages, in particular that they are difficult to make draught proof and that the doors can easily be lifted off their mountings by a potential intruder. In addition, the sliding door in such systems is usually mounted on an outer track to slide outside the adjacent fixed panels or windows, so that it is not possible to have an outwardly opening window adjacent a sliding door.

The word "track" is used herein to describe (unless the context requires otherwise) any kind of elongate groove, recess or supporting surface.

The present invention provides in one aspect an elongate frame member for a sliding door and window assembly, which frame member is of uniform cross-section and comprises a rigid supporting portion, a portion of L-shaped cross-section one limb of which is common to the supporting portion and adapted to receive one edge of an opening window in its closed position and a flange connected to the supporting portion by an intervening web and extending in the same direction as and substantially parallel to one limb of the L-shaped portion on the side of the said one limb remote from the other limb of the L-shaped portion for interlocking with part of a sliding door in its closed position. The L-shaped portion may also be adapted to receive a fixed window or blank panel in place of an opening window.

In another aspect, the present invention provides a door and window frame assembly comprising an outer perimeter frame, a frame member as defined above mounted in said frame and extending between upper and lower members of the perimeter frame to divide the frame into two areas; a frame for an opening window mounted in a first said area of the perimeter frame with one peripheral edge thereof received in the said L-shaped portion of the dividing frame member and a sliding door frame mounted in the perimeter frame and arranged to slide between a closed position in which it extends across the other said frame area and an open position in which it lies in the first said frame area parallel to and spaced from the window frame, the door being provided along one vertical edge thereof with one or more projections which, when the door it in its closed position, engage between the said flange and the support portion of the dividing frame member.

In another aspect, the invention provides a combination comprising a frame as defined above (hereinafter referred to as an "outer frame") with a door frame slidably mounted on the inner track thereof and another panel frame which may be a fixed patio door type panel and/or a window panel with combinations of fixed and/or openable sections, mounted on the outer track, interlocking with the inner sliding panel mounted in the outer track. In a further aspect, the invention provides a kit of parts for constructing such a combination comprising a plurality of frame parts, preferably extruded, including an outer frame part having thereon a track for a sliding door frame and a track for a said fixed panel frame, a door frame part adapted to be slidably mounted on the first said track and frame parts for a said fixed panel shaped to interlock with the second said track.

The invention also provides a method of constructing a combined sliding door and fixed panel unit, which method comprises mounting in an outer wall of a buildng an outer frame as described above, with the sliding door track on the inside of the outer frame relative to the building, and the fixed track on the outside, mounting on the inner track a frame fitted to a sliding door and mounting on the outer track a frame fitted to a said fixed panel.

A preferred embodiment of the present invention will now be described with reference to the accompanying drawings wherein.

Figure 1:
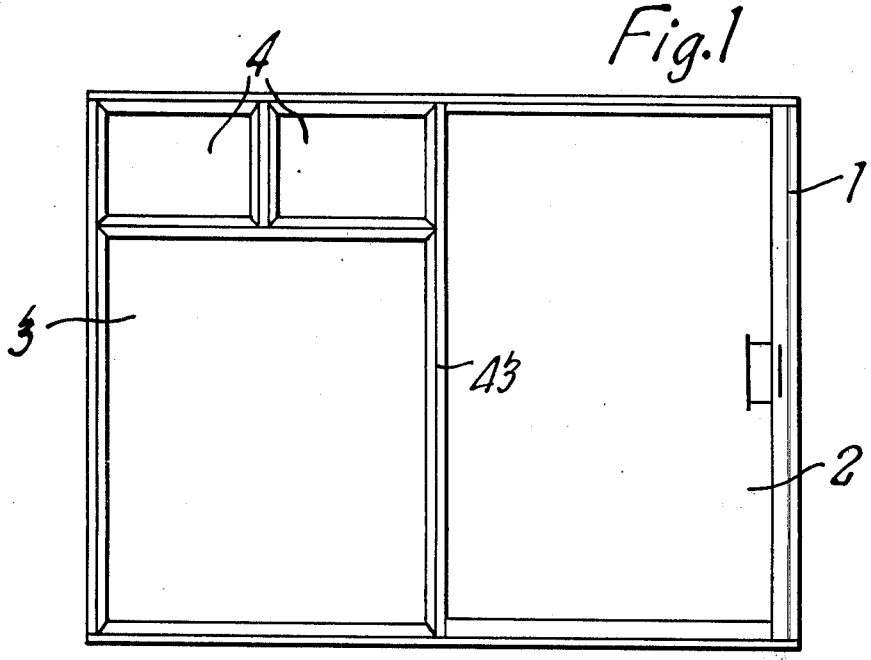
FIG. 1 shows an example of combined door and window panel units constructed in accordance with the present invention.
Figure 3:
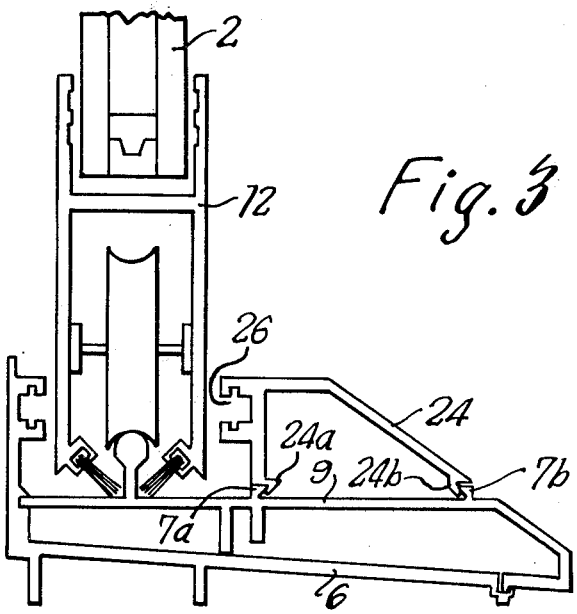
FIG. 3 is a vertical section through the system of FIG. 2 showing the sliding door in its closed position with a draught shield fitted to the outer track opposite the closed sliding door.
Figure 2:
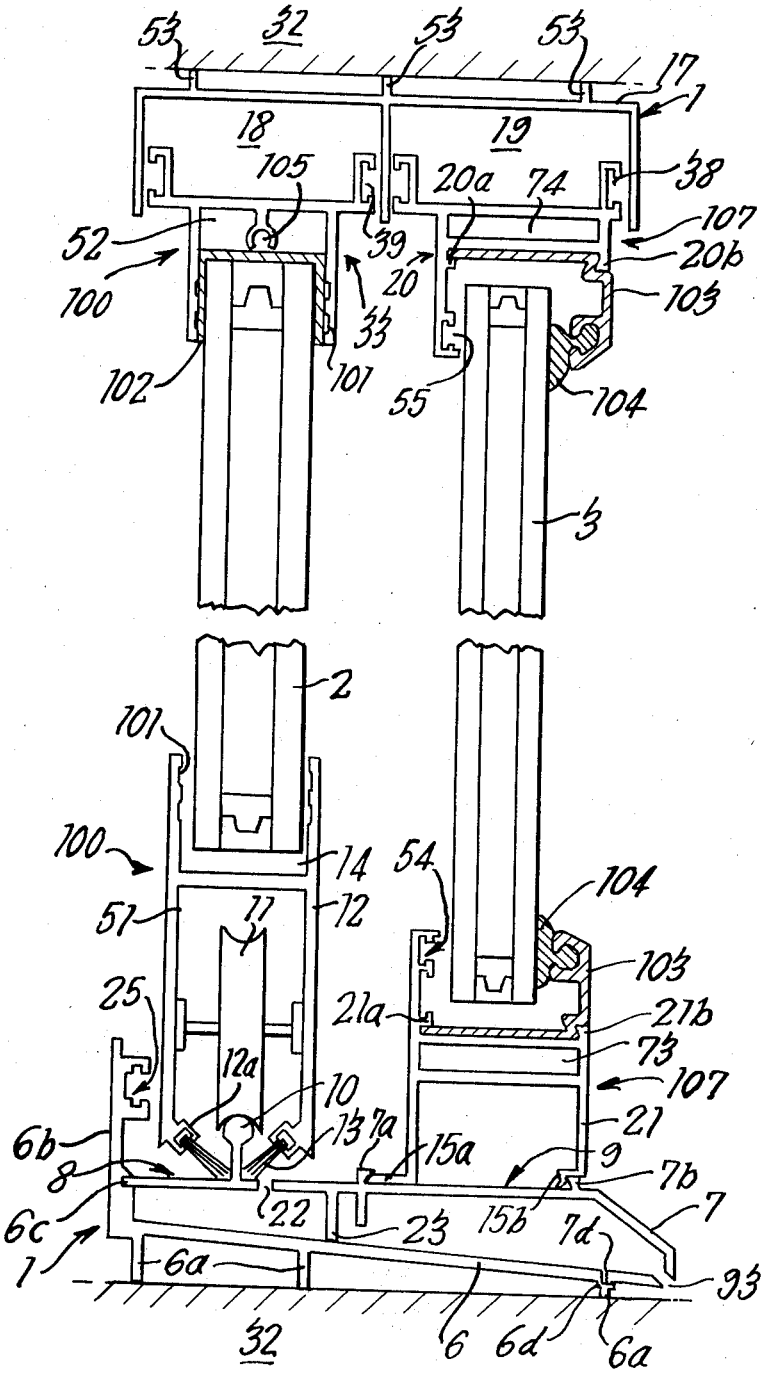
FIG. 2 is a vertical section through a combined sliding door/fixed panel unit in accordance with the invention.

The unit of FIG. 1 has an outer perimeter frame 1, made of extruded strips of anodized aluminium or other suitable materials such as steel (galvanized) or rigid plastics, in which are mounted a sliding door 2, a fixed panel 3, both of which may be in the form of sealed double glazed panels or blank panels, and the fixed panel 3 incorporating opening windows 4. A centrally located vertical dividing member 43 of the invention completes the frame for panel 3 and its windows 4; member 43 also provides sealed closure of the adjacent vertical edge of door 2, when in closed position. As is best seen in FIG. 2, the fixed panel 3 is mounted in an inner frame 107 which is also made of extruded strips and engages within locking channel in the outer frame. The sliding door 2 is mounted in an inner frame 100 which slides along an inner track 10 of the outer frame 1, and the fixed panel 3 is mounted to interlock in a snap fit with outer track 9. The inner and outer tracks are divided by an abutment ridge 7*a*. In FIGS. 2 and 3, the inside of the building in which the unit is fitted is on the left-hand side of the figure and the outside is on the right.

Referring to FIG. 2, an outer perimeter frame 1 comprises a lower member of hollow cross-section made up of interlocking strips 6 and 7 and an integral upper portion 17 having two parallel channels 18 and 19 to receive upper parts 33 of the inner frame 100, 107 for the sliding door 2 and the fixed panel 3, respectively. The interlocking strip 6 of the bottom portion of the base frame has three parallel ridges or leg projections 6*a* to abut the horizontal bottom of an opening in a wall 32 in which the base frame is mounted. The strip 6 also has a vertical flange portion 6*b* which includes a groove 6*c* into which one edge of the strip 7 fits, and a channel 25 between outwardly projecting claws to hold a strip of draught proofing material. The strip 7 has on its underside a ridge 23 which abuts the strip 6 when the two strips are interlocked by snap engagement of a rib 7*d* with a recess *6d* provided by a web on which one of the ridges *6a* is mounted.

The lower edge of the door 2 is received in a channel 14 formed in a lower frame member 12 of generally H-shaped cross-section. The lower frame member 12 also has a channel 51 in which two wheel assemblies 11 are mounted. The door 2 rides on the wheels 11 along a rail 10 which is an integral part of strip 7. Brushes 13 are fixed in elongate claws 12*a* along the length of the lower edges of the lower frame member 12, on either side of the rail 10. Draught proofing material (not shown) in the channel 25 bears against the lower frame member 12 of the door to provide a draught proof seal along the bottom inside face of the door.

The upper edge of the door 2 is received in a channel 52 of the upper part 33 of inner frame 100. The upper frame parts 20,33 are received in channels 18 and 19 in the upper portion 17 of the outer frame. The frame parts 20,33 have recesses 38 and 39 respectively facing the sides of the channels 18 and 19 to hold strips of draught proofing material. These strips bear against the sides of the channels to give a draught proof seal. The upper frame portion 17 also has three parallel ridges 53 which abut the top of the opening in the wall 32 in which the outer frame is mounted. The upper and lower outer frame members can be secured to the wall 32 by conventional means, such as screws (not shown). On the outer track 9, there is fitted a lower inner frame member 21 supporting the sealed double glazed window unit 3, by means of a snap-fit bead 103 and filling strip 104, which extend along all four sides of the window. The beads of the upper and lower members 20,21 are held in position by respective projections 20*a*, 20*b* and 21*a*, 21*b*. The frame member 21 snaps resiliently onto the track 9. Along one lower edge of the frame member 21 is a flat strip or flange 15*a* which abuts the limb 7*a* along one edge of the track 9. Along the other lower edge of the lower frame member 15 is an angled rib 15*b* which defines a groove into which interlocks a correspondingly angled rib 7*b* along the other side of the track from the limb 7*a*. The upper edge of the window 3 is supported by a frame member 20 which extends into the channel 19 of the upper base frame member 17. The frame members 20 and 21 are provided with channels 55 and 54 between adjacent claws for retaining draught excluding material or a PVC gasket. Because the window 3 is supported on the outer track and the door 2 on the inner track, a hinged window section 4 can be included in the panel 3 and arranged to open outwardly without interfering with the movement of the door.

The inner frame parts 20,21 are provided with internal channels 74, 73 respectively, whereby adjacent inner frame parts can be joined by mitre joints, right-angle members being inserted into the channels of the adjacent frame parts.

The door panel 2 may be secured in its supporting or framing channels by conventional means, usually by a PVC gasket of U-shaped cross-section surrounding the edges of the door. Such a gasket is shown at 102 securing the upper edge of the fixed panel 3. The channels 14 and 52 have grooves 101 on their inner vertical sides to enable the gaskets 102 to be gripped more securely.

FIG. 2 also shows a drainage system in the bottom portion of the outer frame. Holes 22 are cut into the upper interlocking strip 7 on the outer side of the rail 10. These holes are provided at intervals along the length of the strip 7. Any rainwater which might tend to accumulate along the track 8, and which might otherwise tend to be blown into the building, instead drains through the holes 22 into a hollow chamber between the strips 6 and 7, through gaps provided in the rib 23 of the upper strip 7 and out through openings 93. Thus there is no tendency for rainwater to be blown back into the building, as often happens when rainwater has to drain directly off a door or window still.

FIG. 3 shows how a draught excluding tread-plate 24 can be fitted to the track 9 by snap engagement along the length of that part of the track which lies opposite the door 2 in its closed position. A flange 24*b* along one edge of the tread-plate bears against the rib 7*b* and a flange 24*a* along the opposite edge bears resiliently against the limb 7*a*. The tread-plate 24 has a recess 26 into which can be clamped a strip of draught proofing material to bear against the door 2.

Figure 4:
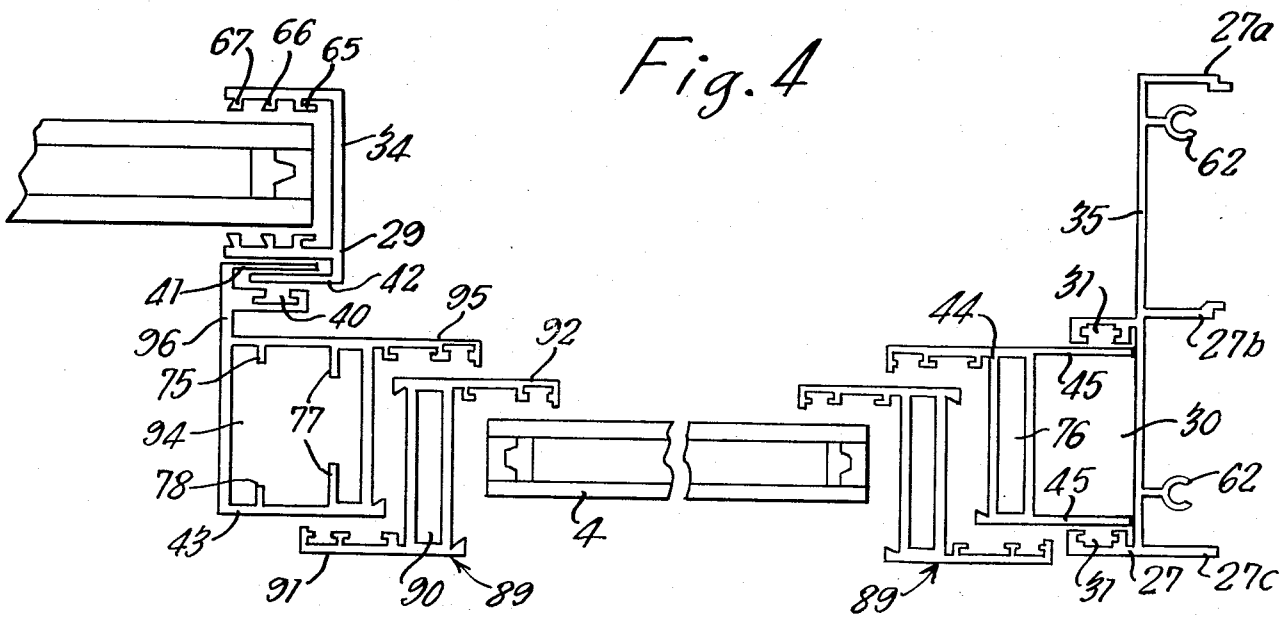
FIG. 4 is a horizontal cross-section through the system of FIG. 2 fitted with an opening window unit showing the interlocking system between the sliding door and the window unit and FIG. 5 is a horizontal section through an alternative system showing how a further window unit can be installed on the other side of the door.

As can be seen from FIG. 4 the door and fixed panel units of FIGS. 1 to 3 are mounted between extruded outer side frame members 27 also of anodized aluminium, which form part of the outer frame 1 and which will be understood to be attached at their upper end to the ends of a top outer frame member 17 and at their lower ends to the interlocking bottom outer frame members 6 and 7, by screws passing through the frame members 6, 7 and 17 into screw channels 62 in the outer side frame members 27. The outer side frame members 27 can be secured to the sides of the opening in the wall 32 by conventional means, as via the upper and lower frame members 17 and 6-7, respectively. Flanges 27*a*, 27*b* and 27*c* abut the building wall 32. Each of the outer side frame members 27 has a channel 30 to receive an inner side frame member of a door or fixed panel. On either side of the channels 30 are arranged recesses 31 in which can be fitted strips of draught proofing material.

Figure 5:
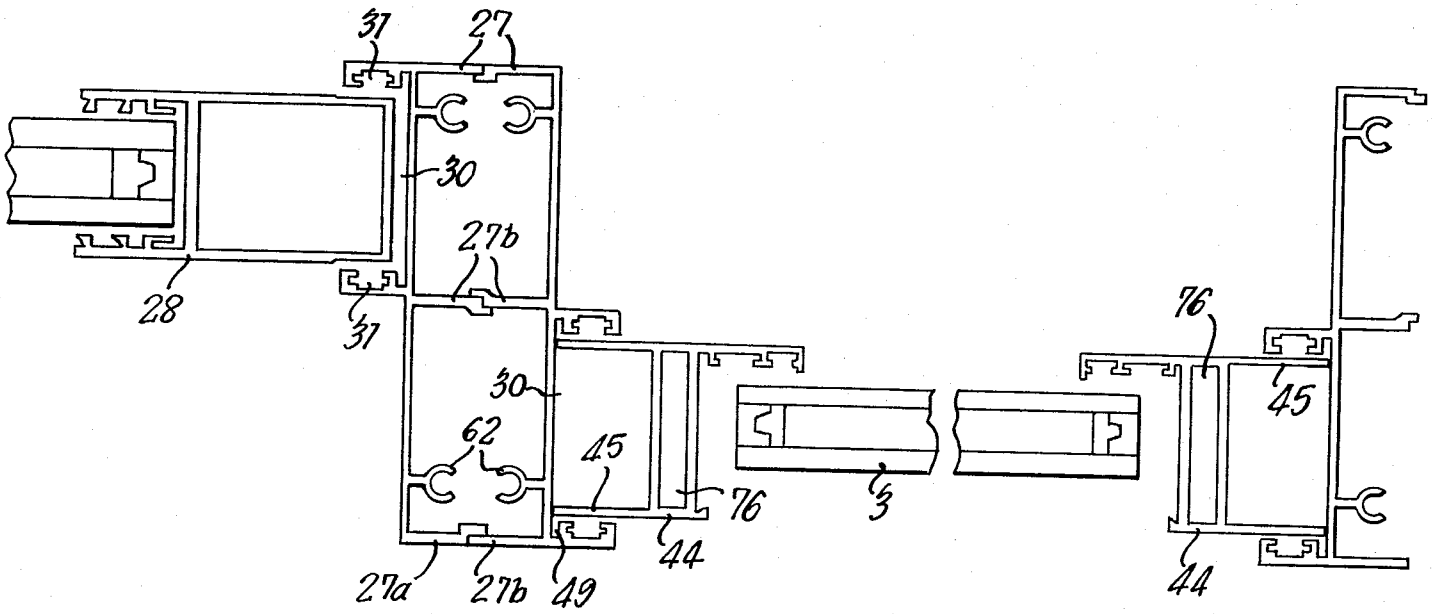

The sliding door 2 is mounted between inner frame side members 28 (see FIG. 5) and 29 (see FIG. 4) which are attached by square joints, to the upper and lower inner door frame members 12 and 33. The side frame member 29 has a flat surface 34 which, when the door is fully opened abuts a rubber bumper (not shown) attached to flat surface 35 of the opposite outer side frame member 27. When the door is shut, as shown in FIG. 5, the side frame member 28 is received in the channel 30 of the corresponding outer side frame member 27. Strips of draught proofing material secured in the recesses 31 on either side of the door side frame member 28 ensure a draught proof seal.

In FIG. 5, fixed patio door type panel 3 is mounted between inner side frame members 44 which in turn will be understood to be joined by square joints to the upper and lower inner frame members 12 and 33 shown in FIG. 2. The frame members are secured by right angle members inserted into the channels 73,74 of the upper and lower frame members and into channels 76 of adjacent side frame members 44. The side frame members 44 are fixedly secured for example by screws, in the channels 30 of side base frame members 27. Sidewalls 45 of the frame members 44 abut the inner walls of channels 30.

FIG. 4 shows the relation of extruded-metal parts for the case of an opening window 4 mounted in frame members 89 forming the outer frame of a casement. Each of the frame members 89 has a central box-section portion 90, adjacent members 89 being secured together at right angles by right angle members inserted into these box-section portions. The frame members 89 also have projecting flange strips 91, 92 which together with the central box-section portions 90 define L-shaped recesses adapted for receiving and securing window panels; members 89 are further provided with projections and recesses similar to those in the corresponding portions of frame members 44 (and as shown at 21*a*, 21*b*, and 54 in FIG. 2) for snap-fit reception of bead means as at 103 in FIG. 2. The window will be understood to be hingedly connected to the inner frame, as along its top edge so as to open outwardly from the bottom.

As earlier noted, the vertical dividing frame member 43 divides the perimeter frame into two areas occupied respectively by the door and the window when the door is closed. This frame member comprises a body or supporting portion 94 of box-section which is shown to comprise four walls A, B, C. D. An integrally formed strip or first flange 95 extends from the box section to define, together with the wall A of the box section a recess of L-shaped cross-section which is of identical configuration to those of the frame members 44 and 89 and which can thus receive an opening window, as shown in FIG. 4, or a fixed panel secured as shown in FIG. 2. When the door is closed, the space between the dividing frame member 43 is closed by a web or flange 96 integral with and extending from the boxlike support portion 94, web 96 including a second flange 41 which, when the door 2 is closed, interlocks with a corresponding flange 42 on the side frame member 29 of the door; this flange 42 engages between the flange 41 and a projection or further flange 41' extending from the web 96, and a recess 40 on projection 41' faces the flange 41 to hold a strip of draught proofing material, so as to ensure a draught proof seal between the sliding door 2 and the dividing frame member 43. Ribs 65, 66 and 67 are provided on either side of a channel of the door frame member 34 which receives an edge of the door, to engage ridges in a U-shaped PVC gasket such as 108 around the perimeter of the door.

The dividing frame member 43 is provided inside its box-section supporting portion with internal ribs 75, 77 and 78 to give extra rigidity. The frame members supporting the window units 4 are joined to one another by mitre joints and secured by inserting right-angled corner keys (not shown) into channels 74 and 76 and those formed by the ribs and 77, and by crimping the flanges into depressions in the corner keys.

In FIG. 5 two strips 27 having the same cross-section as the side base frame members 27 are secured together in back to back relationship to form a dividing frame member presenting on one side a recess 49 to receive a side frame member 44 of a window 4, the window in this case being supported down each side by identical inner side frame members 44 and on the other side a recess 50 to receive a side frame member 28 of a door 2. Thus in this case the door is arranged when opening to slide away from the window 4 instead of alongside it as in FIG. 11. The projections 27*a*, 27*b* and 27*c* of the respective strips 27 engage to enable the two frame members to be aligned and secured together in back to back relationship.

It can thus be seen that by means of the invention, a comprehensive range of sliding door, window and blank panel units can be constructed using relatively few different extrusions. This allows for the first time, a fully co-ordinated use of sliding door panels in conjunction with window panels with projected opening ventilator sections, thus providing the flexibility to co-ordinate various panels of the system to "glaze" whole sections of residential units and yet combine the functions of door and windows in one installation. This in turn allows considerable saving in costs when compared to the combination of other materials required to provide similar functions, as well as simplicity of manufacture, construction and installation. The positioning of the door on an inner track, as well as making draught proofing easier, makes it very much more difficult for the door to be lifted off its track from the outside by an intruder. The spacing apart of the inner and outer tracks allowed by the configuration of the dividing frame member of the invention, leaves space for window catches and the like so that the door does not interfere with opening windows.

I claim:

1. An elongate extruded metal frame member comprising in cross-sectional view: a supporting portion of hollow box section, a first flange extending a first wall of the box section to define with a second wall an L-shaped recess, a web extending a third wall of the box section, a second flange connected to said web and extending in the same direction as and parallel to said first flange, a projection extending from said web in the same direction as said first and second flanges and having a recess facing said second flange for retaining draught excluding material, said first and second walls having projections extending over said second wall for retaining a glazing bead adjacent said second wall, said first wall having a pair of adjacent claws facing toward the L-shaped recess and defining between them a channel for retaining draught excluding material or a glazing gasket.

2. A frame member as claimed in claim 1 which is a single extrusion.

3. A frame member as claimed in claim 1, wherein said supporting portion is of square or rectangular cross-section.

4. A frame member as claimed in claim 1, wherein said web extends a wall of said supporting portion opposite to said first wall.

5. A frame member as claimed in claim 1, wherein the hollow supporting portion includes an internal channel shaped to insertably receive a right-angled member for joining the said frame member to another frame member at right angles thereto.

6. A frame member as claimed in claim 1, wherein the first and second wall are formed with projections for retaining a glazing bead against the second wall.

7. A frame member as claimed in claim 1, wherein the first wall is formed with adjacent claws facing towards said L-shaped recess and defining between them a channel for retaining draught excluding material or a gasket.

8. A sliding door and window frame assembly comprising a sliding door frame, a frame for a fixed panel and hinged window, a hinged window frame, an outer perimeter frame having an inner track for said sliding door frame and an outer track for said fixed panel and hinged window frame, a dividing frame member extending vertically to divide said perimeter frame into a door area and window area, said dividing frame member having an L-shaped portion extending into said outer track and forming an edge of said fixed panel and hinged window frame, said dividing frame member having an inwardly extending flanged web extending into said inner track for defining an interlocking closure for said door frame, said door frame having on its inner vertical edge a continuous projection adapted in the closed door position to engage within said flanged web, the remainder of said fixed panel and hinged window frame being interlockingly engaged in said outer track of said perimeter frame with said window frame mounted to open outwardly therefrom; said inner track comprising a rail positioned centrally along the track on a lower member of said perimeter frame, said second track comprising a channel in said perimeter frame defined between a pair of parallel ridges, said remainder of said fixed panel and window frame engaging with a snap fit between the said ridges, said lower perimeter frame member being of hollow cross-section and provided with draining means; and said lower perimeter frame member being constructed of separate upper and lower interlocking parts, said upper part having a horizontal floor formed with said rail and with drainage holes, and said lower part sloping downwardly and outwardly over its full width, there being drainage outlets at an outside lower corner of the lower frame member, the lower part having external legs terminating on a horizontal plane, one said leg being adjacent the inner edge of the lower frame member, said lower part having an inner vertical flange portion formed with a pair of claws defining a recess for retaining draught-excluding material, said recess facing outwardly towards said inner track.

9. In a sliding door and fixed panel assembly: a hollow lower frame member having interlockingly engaged upper and lower parts formed as extrusions, said upper part having a horizontal upper surface and a rail defining an inner track for a sliding door and projections in an outer track for interlockingly retaining a tread member or fixed panel frame, and having drainage holes under both tracks, said lower part having an upper surface sloping downwardly and outwardly over its width, drain outlets at the lower outer edge of the frame member, leg projections extending downwardly from said lower part and terminating in a horizontal plane, the frame member having an upwardly extending rear flange, said flange being formed with a pair of claws defining a recess for retaining draught excluding material, said recess facing outwardly towards said inner track, a fixed panel assembly interlockingly engaged in said outer track projections over a first part of the length of the lower frame member, a door slidingly engaged on said rail, and a tread plate interlockingly engaged in said outer track projections over a second part of the length of the lower frame member.

10. An assembly as claimed in claim 9, wherein said rear flange is integral with said lower part and extends continuously upwardly from said upper surface of said lower part, there being a groove in said flange into which the inner edge of the upper part is engaged.

11. An assembly as claimed in claim 8, wherein the outer perimeter frame has extruded vertical side members of identical cross-section so formed that two such members can be interlocked back to back from a dividing vertical pillar of box section.

* * * * *